United States Patent [19]

Morrison

[11] 4,342,497

[45] Aug. 3, 1982

[54] BATTERY TERMINAL CONNECTOR

[75] Inventor: Charles A. Morrison, Roodepoort, South Africa

[73] Assignee: National Motor Spares Corporation, Miami, Fla.

[21] Appl. No.: 123,802

[22] Filed: Feb. 22, 1980

[30] Foreign Application Priority Data

Sep. 7, 1979 [ZA] South Africa ..... 79/4739

[51] Int. Cl.[3] ..... H01R 11/12; H01R 13/52

[52] U.S. Cl. ..... 339/228; 339/95 B; 339/116 C

[58] Field of Search ..... 339/116 R, 116 C, 95 B, 339/263 B, 224–240

[56] References Cited

U.S. PATENT DOCUMENTS

| | | | |
|---|---|---|---|
| 1,699,925 | 1/1929 | Schmidt | 339/230 R |
| 2,168,250 | 8/1939 | Toiberg et al. | 339/228 X |
| 2,657,370 | 10/1953 | Hobson | 339/225 X |
| 2,906,988 | 9/1959 | Stocking | 339/116 R |
| 3,521,223 | 7/1970 | Martinez | 339/239 R |
| 3,662,322 | 5/1972 | Morrison | 339/95 B |
| 3,928,079 | 12/1975 | Jennings et al. | 339/116 R X |
| 4,012,104 | 3/1977 | Wening | 339/116 C |
| 4,270,827 | 6/1981 | Potgieter | 339/95 B |

*Primary Examiner*—Eugene F. Desmond

*Attorney, Agent, or Firm*—Stevens, Davis, Miller & Mosher

[57] ABSTRACT

A battery terminal connector comprising a body made of electrically insulating material and having a socket extending transversely into the body towards one end thereof and adapted, in use, to receive a battery terminal post, a passage extending through the body in a direction transverse to the socket and a battery post engaging connector block axially movable within the passage so as to be co-operable with a battery terminal post received within the socket in use, at least one aperture in the body and adapted to expose a part of the electrically conductive surface of a battery terminal post or the connector block or both while the connector is attached to such terminal post.

10 Claims, 4 Drawing Figures

BATTERY TERMINAL CONNECTOR

This invention relates to battery terminal connectors, and more particularly, to battery terminal connectors of the type having an insulating body containing a socket extending transversely into one end of the body. A passageway is formed within such a body and within which is located an axially movable battery post engaging connector block adapted to be urged into contact, transversely, with a battery terminal post located in the socket.

Various forms of battery terminal connectors of the above type have been proposed. However, all of them, as far as Applicant is aware, suffer from at least one disadvantage in that, whilst such a connector is attached to a battery terminal post, it is substantially impossible to connect, by means such as a crocodile clamp, an auxillary electrical supply cable to the battery, in cases for example, where the battery has only a low charge therein or is otherwise insufficiently strong to start or otherwise power a motor vehicle.

It is the object of this invention to provide a battery terminal connector of the above described type wherein a crocodile clamp, or other suitable electrical connector, can be electrically connected to a battery terminal post whilst the connector is attached thereto.

In accordance with this invention there is provided a battery terminal connector comprising a body made of electrically insulating material and having a socket extending transversely into the body towards one end thereof and adapted, in use, to receive a battery terminal post, a passage extending through the body in a direction transverse to the socket and communicating with the socket, and a battery post engaging connector block axially movable within the passage so as to be co-operable with a battery terminal post received within the socket in use, the body being characterised in that it is provided with at least one aperture adapted to expose a part of the surface of a battery terminal post or connector block or both whilst the connector is attached to such post.

Further features of the invention provide for said aperture to have a removable or hinged cover member for removably closing the aperture, for the cover member to be either the upper portion of the body defining the socket so that the lower portion thereof is rigidly attached to the remainder of the body, or alternatively, the side portions of the body adjacent the connector block, for the post-engaging connector block to be urged towards the socket by means of a compression spring introduced between the connector block and a closure member co-operating with formations at the end of the body remote from the socket, and for the closure member to co-operate with the body by means of bayonet and socket formations co-operating with each other.

Preferably the body of the battery terminal connector is injection moulded from a suitable plastics material having the desired chemical resistance and other properties required of a battery terminal connector.

Whilst the present invention is further described with reference to a substantially conventional truncated conical shape of battery terminal post, the invention may equally well be applied to flat lug type of posts as are sometimes available particularly in smaller or lower capacity batteries.

Two embodiments of the invention will now be described with reference to the accompanying drawings in which.

Figure 1:
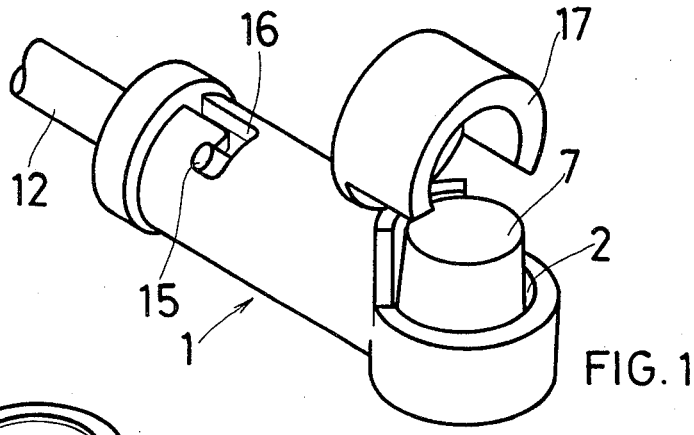
FIG. 1 is an isometric view of one form of battery terminal connector according to this invention with the cover member in an open condition relative to a battery terminal post.
Figure 2:
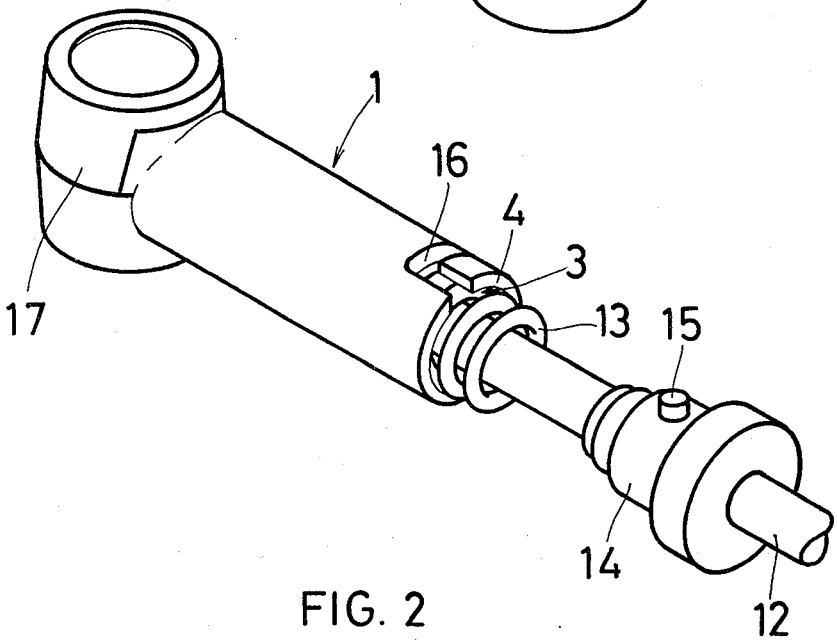
FIG. 2 is another isometric view of the same battery terminal connector showing the closure plug in an open condition and the cover member in a closed condition.
Figure 3:
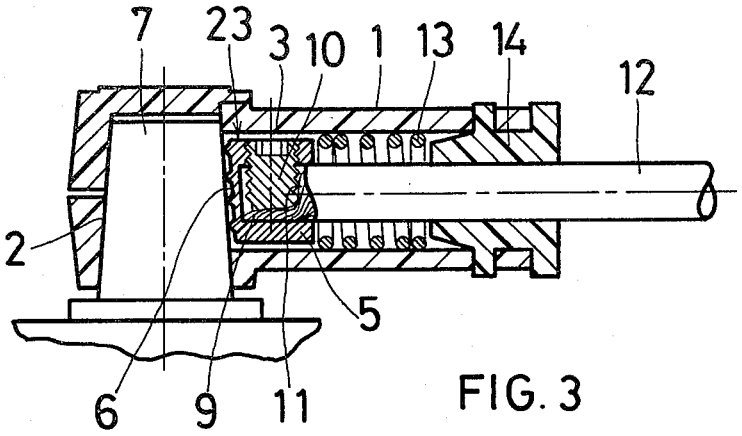
FIG. 3 is a longitudinal sectional elevation of the battery terminal connector in an operative condition on a battery terminal post, and, FIG. 4 is a view similar to FIG. 2 of a second embodiment of the invention.
Figure 4:
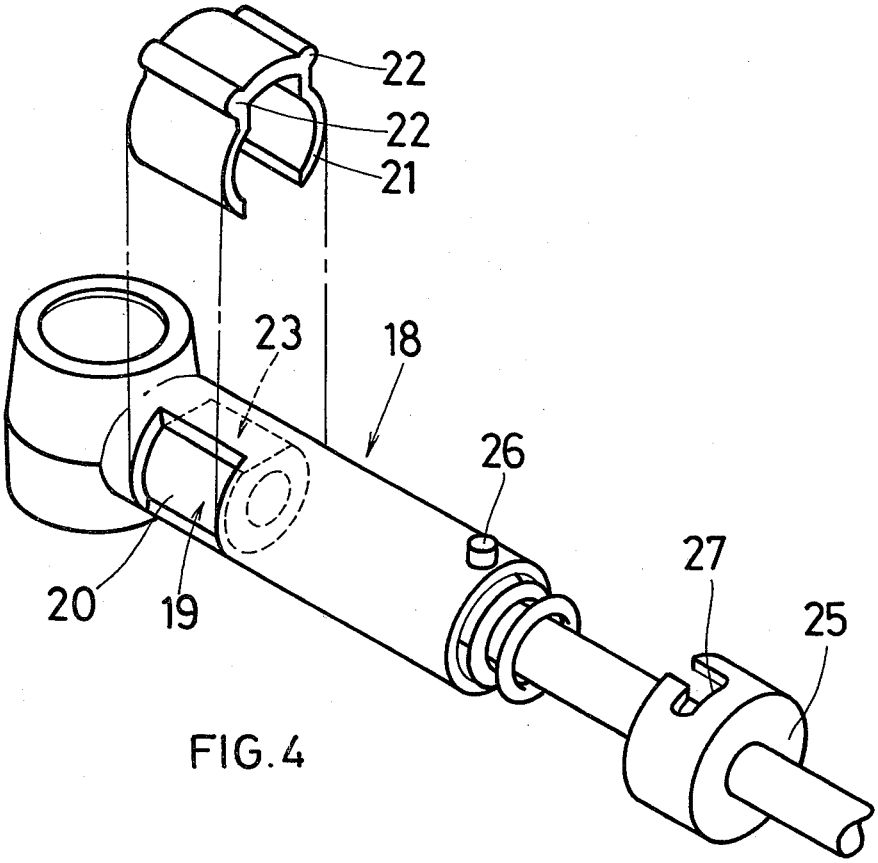

In the embodiment of the invention illustrated in FIGS. 1 to 3 of the accompanying drawings, a battery terminal connector comprises a body 1 made of injection moulded plastics material. The body has a generally elongated cylindrical shape in this particular instance and a transverse socket 2 is provided at one end thereof with the axis of the socket being at right angles to the axis of the body. A passage 3 communicates with the socket through the body, this passage extending axially along the length of the body from the end 4 thereof remote from the socket into the socket itself.

Axially slidable within this passage is a terminal post engaging connector block 5 having a post engaging face 6 which is adapted to form a good electrical connection with a battery terminal post 7 when it is urged towards said post. To this end the post engaging face 6 may be provided with a multitude of small conical projections 8 having a large cone angle so that the projections will actually bite into the external surface of the battery terminal post which is generally of a deformable material, and in particular, lead.

The post engaging block 5 has a blind hole 9 extending axially therein from the end opposite the post engaging surface 6 and a transverse grub screw 10 is provided in a complementary transverse hole for clamping the wires 11 of an electrical cable 12 to enable the wires 11 to be firmly clamped in the blind hole.

In the operative position of the battery terminal connector, a spring 13 bears against the outer end of the terminal post engaging connector block.

The opposite end of the spring 13 bears against a closure plug 14 releasably fitted into the end of the body remote from the socket.

Conveniently the closure plug has diametrically opposed outwardly directed lugs 15 on its outer surface which co-operate with specially shaped slots 16 in the end region of the body in the well-known bayonet and socket type of fashion.

The spring is therefore placed under compression within the body by installing the closure plug in its position which naturally has a tendency to compress the spring.

It will be understood that assembly of a battery terminal connector as above described is simple in that the cable can be easily secured to the post engaging connector block simply by the use of a suitable Allen key. Such Allen key can be inexpensively manufactured by selection of the correct cross-sectional dimensioned hexagonal rod and simply bending lengths of rod to the required shape. It is thus envisaged that when the invention is marketed in kit form for replacing existing battery terminal connectors an Allen key can be included in the kit without raising the price thereof to any appreciable extent.

Once the post engaging connector block has been located within the body the spring and closure plug can be installed in position so that the spring is placed somewhat under compression. The battery terminal connector may then be installed on a battery terminal post simply by pulling the cable hard against the action of the spring to withdraw the post engaging block into the passage and out of the socket. The socket is then located over the battery terminal post and the cable then released, whereupon the spring urges the post engaging connector block into firm electrical contact with the battery terminal post.

In order to enable a crocodile clip or other electrical connecting member to be connected to the battery terminal post whilst a battery terminal connector is installed thereon, the body 1 of the battery terminal connector is provided with a hinged cover member 17 defining the upper region of the socket. The section 17 is clearly shown in FIG. 1 in the open condition and wherein the upper portion of the battery terminal post 7 is clearly exposed and therefore capable of receiving a crocodile clip. The section 17, which is hingedly attached to the rest of the body, is adapted, in any suitable manner, to clip into the closed position so that it will normally be retained in a position in which it is located snugly over the battery terminal post. However, when required this section can be hinged upwardly to expose part of the battery terminal post as illustrated in FIG. 1.

It will be understood that many variations may be made to the above described embodiment of the invention without departing from the scope thereof. In particular, the method of connecting an electrical cable to the post engaging block may be varied as required and in fact, permanent connections of a cable to such a block can be utilised where the assembly is aimed at the original equipment market in the motor vehicle industry. Also, the upper portion of the socket which is hingedly attached to the body in the above described embodiment of the invention could be replaced by, for example, a pair of removable side sections to the portion of the body defining the socket such that two opposed surfaces of the battery terminal post are exposed when these sections are removed.

A further alternative, and one which facilitates manufacture of a body of a battery terminal connector according to this invention, is illustrated in FIG. 2 and is a second embodiment of the invention.

As illustrated, the plastics moulded body 18 is substantially the same as is described with reference to FIGS. 1 to 3 apart from the following differences.

Firstly, the part of the body defining the socket is made as a single piece and has no removable cover member to expose a part of the battery terminal post itself. Instead of this removable cover member the body has a pair of apertures 19, one on each side of the body, and adjacent the socket end of the connector so that the post engaging connector block 20 is exposed on each side. The apertures are such that a crocodile clip or the like can be engaged with the sides of the block in order to connect an auxillary cable to the battery terminal post electrically, although indirectly.

A cover member 21 is provided for both of the apertures and consists of a plastic moulding of substantially C-shape in cross-section. This cover member has a pair of oppositely directed finger gripping formations 22, one on each side thereof, and arranged so that these formations can be manipulated in order to clip the cover member over the apertures releasably. Conveniently the outer surface of the cover member, apart from the finger grip formations, is made to substantially conform to the outer surface of the body on the sides thereof.

Thus, again, the cover member can be removed as and when required in order to allow a crocodile clip or the like to be engaged with the electrically conductive interior of the assembly and in this case with the battery post engaging connector block.

It must be mentioned that the connector block is preferably made to a circular shape in cross-section but segmented by providing a flat side 23 along the upper surface thereof in the operative orientation. This has the advantage of ensuring that the post engaging connector block assumes a fixed orientation when urged towards the socket, this being necessary as a result of the fact that the post engaging face of the connector block is generally inclined complementarily to the inclination of a battery terminal post. In addition to this advantage the cross-sectional shape just described enables the sides of the connector block to bow outwardly so as to be easily engageable by a crocodile clip or the like. It is considered that this particular cross-sectional configuration of the connector block is more advantageous than that which has been utilised heretofore wherein usually square cross-sectioned or hexagonally cross-sectioned connector blocks are utilised.

A further difference between the second embodiment of the invention and that described earlier is the closure member 25 provided at the end of the passage remote from the socket. In this case, the pins 26 are made integral with the body itself and the closure member 25 carries the shaped slots 27 to define the required bayonet type of connection. This arrangement provides the advantage that a shorter axial length of the battery terminal connector is required ultimately since the spring can extend the full length of the body as opposed to the case where it is restricted by the plug entering the end of the body.

The invention therefore provides battery terminal connectors having the facility for connecting a crocodile clip or the like electrically to a battery terminal post whilst such a connector is attached thereto in addition to providing additional non-essential advantages or improvements.

What I claim as new and desire to secure by Letters Patent is:

1. A battery terminal connector comprising a body made of electrically insulating material and having a socket extending transversely into the body towards one end thereof and adapted, in use, to receive a battery terminal post and to cover the top and sides of the post, a passage extending through the body in a direction transverse to the socket and a conductive battery post engaging connector block axially movable within the passage so as to be co-operable with a battery terminal post received within the socket in use, the body having at least one removably covered aperture into said passage adapted to expose a part of a conductive surface associated with the battery terminal post while the connector is attached to such post, such exposed part being in a position such that an opposed part of the body can be engaged by a crocodile clamp so that at least one side of said clamp is held in firm engagement with the conductive part and is electrically connected to the battery terminal post.

2. A battery terminal connector as claimed in claim 1 in which said aperture has a removable, optionally hinged, cover member of electrically insulating material for selectively closing the aperture.

3. A battery terminal connector as claimed in claim 2 in which the upper portion of the body part defining the socket forms said cover member and the lower portion of such body part is rigidly attached to the remainder of the body.

4. A battery terminal connector as claimed in claim 1 in which there are a pair of diametrically opposed apertures in the body providing said access, in the operative condition of the connector, so that both sides of said clamp contact the conductive surface.

5. A battery terminal connector as claimed in claim 4 in which a single cover member of electrically insulating material is provided for both of the apertures.

6. A battery terminal connector as claimed in claim 1 in which the post engaging connector block is urged towards the socket by means of a compression spring located between the connector block and a closure member at the end of the body remote from the socket.

7. A battery terminal connector as claimed in claim 6 in which the closure member and body have co-operating formations of a bayonet and socket type.

8. A battery terminal connector as claimed in claim 1 in which the body is injection moulded plastics material.

9. A battery terminal connector as claimed in claim 1 in which the post engaging connector block is of substantially circular cross-section but with a flat surface forming a segmented cross-sectional shape.

10. A battery terminal connector as claimed in claim 1 in which the connector block has a transverse screw-threaded hole therein receiving a screw threaded fastener for clamping electrical wires in a blind hole in the connector block.

* * * * *